US007896476B2

(12) United States Patent
Kubo et al.

(10) Patent No.: US 7,896,476 B2
(45) Date of Patent: Mar. 1, 2011

(54) INKJET PRINTHEAD BOARD AND INKJET PRINTHEAD USING SAME

(75) Inventors: Kousuke Kubo, Yokohama (JP); Yoshiyuki Imanaka, Kawasaki (JP); Takuya Hatsui, Tokyo (JP); Souta Takeuchi, Yokohama (JP); Takaaki Yamaguchi, Yokohama (JP); Takahiro Matsui, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 375 days.

(21) Appl. No.: 11/958,520

(22) Filed: Dec. 18, 2007

(65) Prior Publication Data

US 2008/0151005 A1 Jun. 26, 2008

(30) Foreign Application Priority Data

Dec. 20, 2006 (JP) ..... 2006-343000

(51) Int. Cl.
*B41J 2/05* (2006.01)

(52) U.S. Cl. ..... 347/62; 347/12; 347/50; 347/58

(58) Field of Classification Search ..... 347/50, 347/62, 12, 58
See application file for complete search history.

(56) References Cited

U.S. PATENT DOCUMENTS

| | | | | |
|---|---|---|---|---|
| 5,363,134 | A | 11/1994 | Barbehenn et al. | |
| 5,504,507 | A | 4/1996 | Watrobski et al. | |
| 5,521,619 | A * | 5/1996 | Suzuki et al. | 347/10 |
| 5,956,052 | A | 9/1999 | Udagawa et al. | |
| 6,231,155 | B1 | 5/2001 | Udagawa et al. | |
| 6,278,468 | B1 * | 8/2001 | Watrobski et al. | 347/14 |
| 6,390,589 | B1 | 5/2002 | Imanaka et al. | |
| 6,612,672 | B2 * | 9/2003 | Yasuda | 347/12 |
| 7,309,120 | B2 | 12/2007 | Hatsui et al. | |
| 2007/0245559 | A1 * | 10/2007 | Feinn et al. | 29/890.1 |
| 2008/0043063 | A1 * | 2/2008 | Bergstedt et al. | 347/62 |
| 2009/0002458 | A1 * | 1/2009 | Furukawa et al. | 347/58 |

FOREIGN PATENT DOCUMENTS

| | | | |
|---|---|---|---|
| JP | 3-126560 | A | 5/1991 |
| JP | H6-091877 | A | 4/1994 |
| JP | 8-177732 | A | 7/1996 |
| JP | 2000-127403 | A | 5/2000 |
| JP | 200615736 | A | 1/2006 |

* cited by examiner

*Primary Examiner*—Ellen Kim
(74) *Attorney, Agent, or Firm*—Fitzpatrick, Cella, Harper & Scinto

(57) ABSTRACT

An inkjet printhead board and inkjet printhead is provided having a reliable storage element which allows for print without causing damages to an interlayer insulation film and protection film upon printing data unique to the printhead and is free from the restriction in arrangement position. For this purpose, a printing device board uses therein an information storage element formed common in material and process to electro-thermal converter element, the resistance value of which is changed to enable information storage so that information can be read out of the information storage element.

9 Claims, 10 Drawing Sheets

INKJET PRINTHEAD BOARD AND INKJET PRINTHEAD USING SAME

BACKGROUND OF THE INVENTION

1. Field of the Invention

The present invention relates to an inkjet printhead board and to an inkjet printhead using same.

2. Description of the Related Art

The inkjet printer is of so-called a non-impact print scheme, having features of capable of printing at high speed, capable of printing on various recording media, and less causing noise upon printing. From those, the inkjet printer is broadly employed on an apparatus acting for a print mechanism, e.g. a printer, a copier, a facsimile machine or a word processor.

As for the inkjet printhead, there are known various schemes in respect of forming an ink droplet to eject. Among those, the inkjet printhead utilizing heat as ink-ejection energy realizes comparatively easily a multi-nozzle structure with high density, thus allowing for printing with high resolution and image quality at high speed.

There are cases that a ROM (read only memory) is mounted on a printhead in order to readably store information unique to the printhead, including printhead ID (identity) code and ink ejection mechanism drive characteristics. This function is very effective means in acquiring information unique to the printhead during printing and effecting drive optimally where a removable inkjet printhead is used on the inkjet printer body. For example, Japanese Patent Laid-Open No. H3-126560 discloses that an EEPROM (electrically erasable programmable ROM) is mounted on the printhead. However, in the printhead of Japanese Patent Laid-Open No. H3-126560, the EEPROM is mounted not on the printhead board but separately from the printhead. This makes structure complicate and productivity not well, thus hindering the size and weight reduction of the apparatus. Furthermore, such a ROM is useful in storing a great capacity of information but is not favor in respect of cost where information to store is not great in capacity.

Meanwhile, U.S. Pat. No. 5,363,134 and U.S. Pat. No. 5,504,507 disclose that a ROM having a fuse array is formed together with an ink ejection mechanism layer film on its base plate, i.e. a printhead board. In this case, when forming a layer film having an ink ejection mechanism, etc. on the base plate in the manufacture process of a printhead board, a fuse array to turn into a ROM can be formed at the same time. For example, in case a logic circuit is formed simultaneously with the fuse array and the fuses are selectively blown by controlling the logic circuit after completing a printhead, 2 values information can be held on the fuses in accordance with a presence/absence of meltdown. The printhead having a ROM on its printhead board does not require the preparation of a ROM chip separately from the printhead board, thus being not complicated in structure, well in productivity and realized in reduced size and weight.

FIGS. 10A and 10B are sectional views showing a printhead of an existing inkjet recorder having a ROM on its printhead board. FIG. 10A illustrates the usual state of the printhead while FIG. 10B the state that cracks are caused in an interlayer insulation film 804 and protection film 806.

In the usual inkjet printer, its printhead has a surface formed as an ink holder in the greater part thereof. As can be seen from FIG. 10A, the interlayer insulation film 804 and the protection film 806 exist between a fuse element 803 and an ink liquid 808. Although the fuse element 803 is shown only one in FIG. 10A, a plurality of fuse elements are practically provided on the printhead board. By selectively blowing the fuse elements, data can be held thereon in an amount of square of the number of the fuse elements.

However, heat is involved in blowing the fuse elements wherein, as the fuse elements increase in the number, a greater amount of heat inevitably occurs correspondingly. And there are possibilities that cracks possibly occur in the interlayer insulation film 804 and protection film 806, as shown in FIG. 10B. Where cracks are caused in this manner, ink 808 possibly permeates through the crack and reaches the fuse element 803. It can be considered that, by the permeated ink 808, the blown fuse element 803 is short circuited or a fuse electrode is eroded. Particularly, where a logic circuit for controlling to blow the fuse elements or to read data is arranged close to the fuse element, the ink intruding through the crack reaches the logic circuit resulting in a possibility to pollute the logic circuit and raise a malfunction.

In order to avoid this, Japanese Patent Laid-Open No. 2000-127403 describes a structure that an ink holder, a fuse array and a logic circuit are arranged separate to prevent ink from intruding.

However, the printhead in the recent has a plurality of ink supply openings and a plurality of heaters densely arranged corresponding to the ink supply openings, on one base plate constituting a printhead, in order to meet the demands for higher resolution, image quality and operation speed. Consequently, the base plate for use in a printhead is occupied in greater part thereon by a heater power line, a logic circuit, drive elements, etc., thus making it difficult to arrange an especial fuse element in a position distant from the ink holder.

SUMMARY OF THE INVENTION

Therefore, it is an object of the present invention to provide an inkjet printhead board having a storage element which is capable of storing information without damages to an interlayer insulation film and protection film thereby holding information with high reliability and being free from the restriction in arrangement position. Another object is to provide an inkjet printhead having the same inkjet printhead board.

According to a first aspect of the invention, there is provided an inkjet printhead board having an element for generating ink-ejection energy, the inkjet printhead board characterized by comprising: a resistor provided as an information storage element and having a resistance value corresponding to a temperature of thermal process and formed to be supplied with a current in a manner the resistance value can be read out.

According to a second aspect of the invention, there is provided an inkjet printhead comprising: an inkjet printhead board; and an ejection opening through which ink is to be ejected commensurately with a heat generation at the resistor constituting an element for generating the energy.

The invention uses, as information storage element, a resistor having a resistance value to be changed by conducting a thermal process. The resistance value, obtained by supplying a current, can be read out as information. This makes it possible to store information without causing damages to a high-temperature interlayer insulation film and protection film and to hold information thereon with high reliability because significant heat generation is not caused as occurring upon blowing fuses. Meanwhile, where an energy generating element for ink ejection is provided by a resistor that generates thermal energy by being supplied with a current, the relevant resistor and the resistor constituting the information storage element are to be formed common in material and process. Therefore, the restriction to be arranged can be reduced.

Further features of the present invention will become apparent from the following description of exemplary embodiments with reference to the attached drawings.

BRIEF DESCRIPTION OF THE DRAWINGS

FIGS. 8A and 8B are views showing an ink cartridge wherein FIG. 8A is a perspective view as seen from below while FIG. 8B is a perspective view as seen from above;

DESCRIPTION OF THE EMBODIMENTS

First Embodiment

With reference to the drawings, explanation will be now made in detail on a first embodiment according to the present invention.

Figure 7:
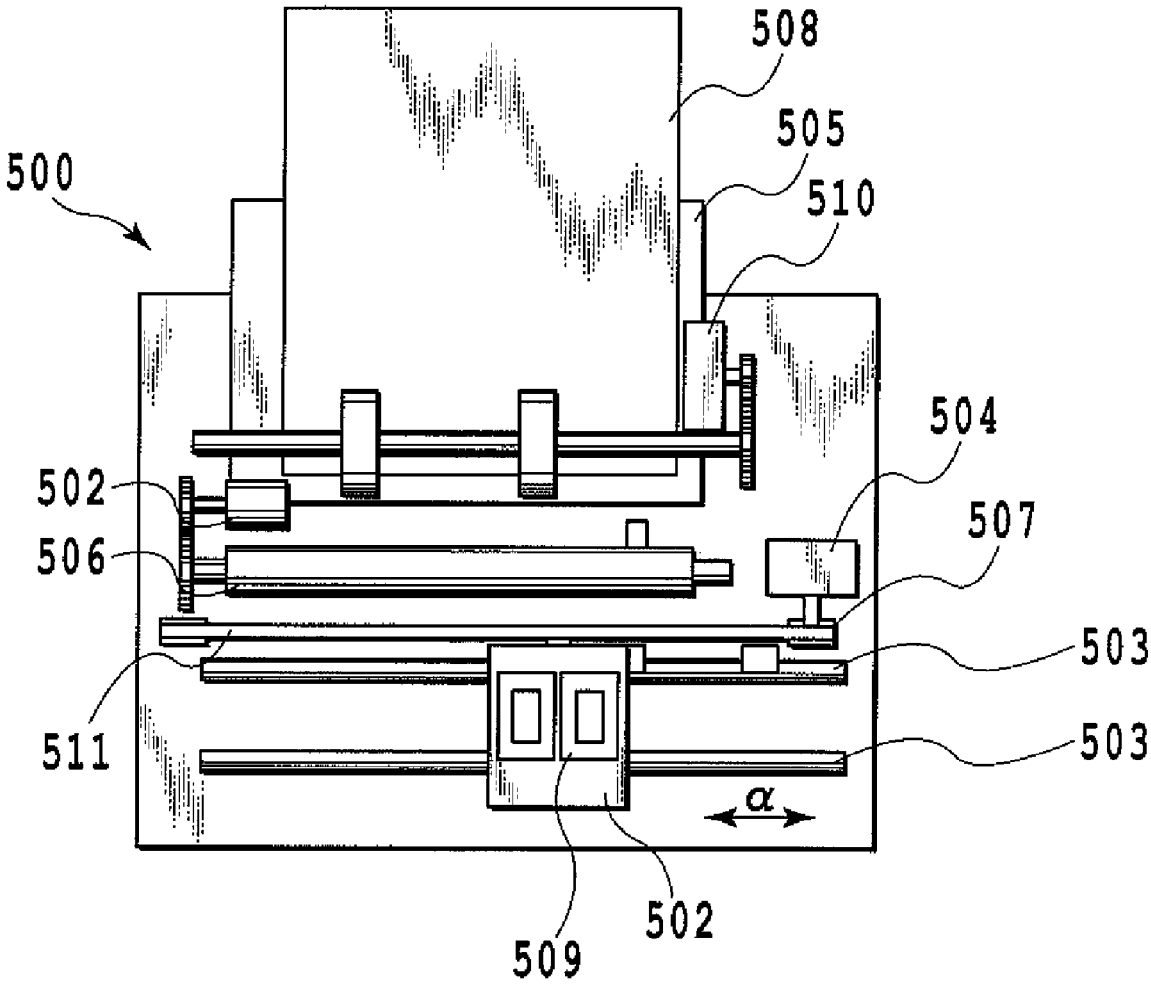
FIG. 7 is a plan view showing an inkjet printer according to the first embodiment.

FIG. 7 is a plan view showing an inkjet printer capable of mounting a printhead according to the present embodiment. In FIG. 7, an auto sheet feeder (ASF) 505 is stacked with printing media 508 that are to be supplied into the inkjet printer 500 by the drive of a paper feeding motor 510. Then, the printing medium 508 is conveyed to a printing site by a conveying roller 506 rotated by the drive of the conveying motor 502. The printing media 508, in the printing site, is held to form a flat printing surface by the platen, not shown.

By driving a carriage motor 504, a carriage 502 is reciprocated in a main scanning direction (in a direction of arrow $\alpha$) over a guide shaft 503 through a motor pulley 507 and a timing bet 511. The carriage 502 mounts an ink cartridge 509 incorporating a printhead and an ink tank therein. Printing is to be carried out by ejecting ink from the printhead while repeating to feed the printing media 508 and to move the carriage 502 alternately.

Figures 8A, 8B:
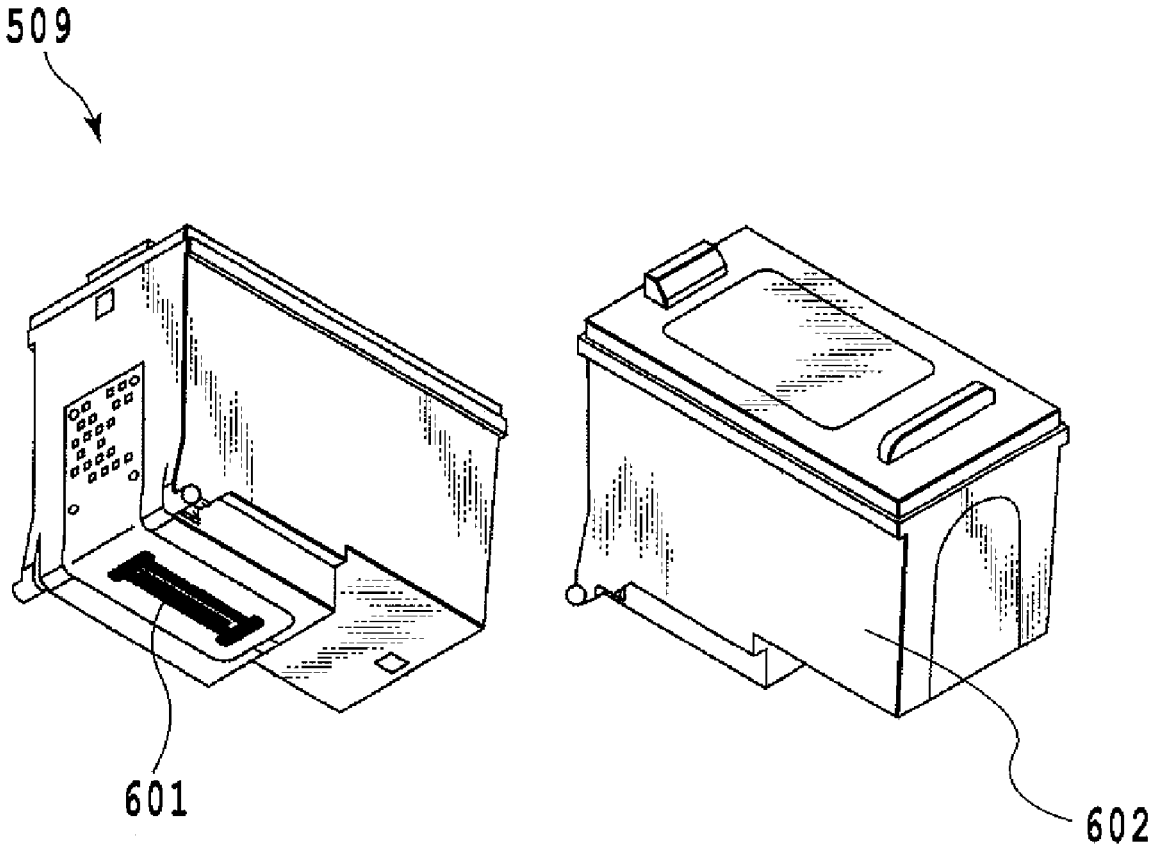

FIGS. 8A and 8B are views showing the ink cartridge 509 according to the embodiment, wherein FIG. 8A is a perspective view as seen from below while FIG. 8B is a perspective view as seen from above. An ink tank 602 has therein an absorber, not shown, that impregnates ink and generates a negative pressure therein, being structured to supply a proper amount of ink to the printhead 601. The printhead 601 is provided on the bottom of the ink tank 602. By receiving print data at the printhead 601, the ink supplied from the ink tank 602 to the printhead 601 is ejected through an ejection opening, not shown, provided in the printhead 601.

Figure 9:
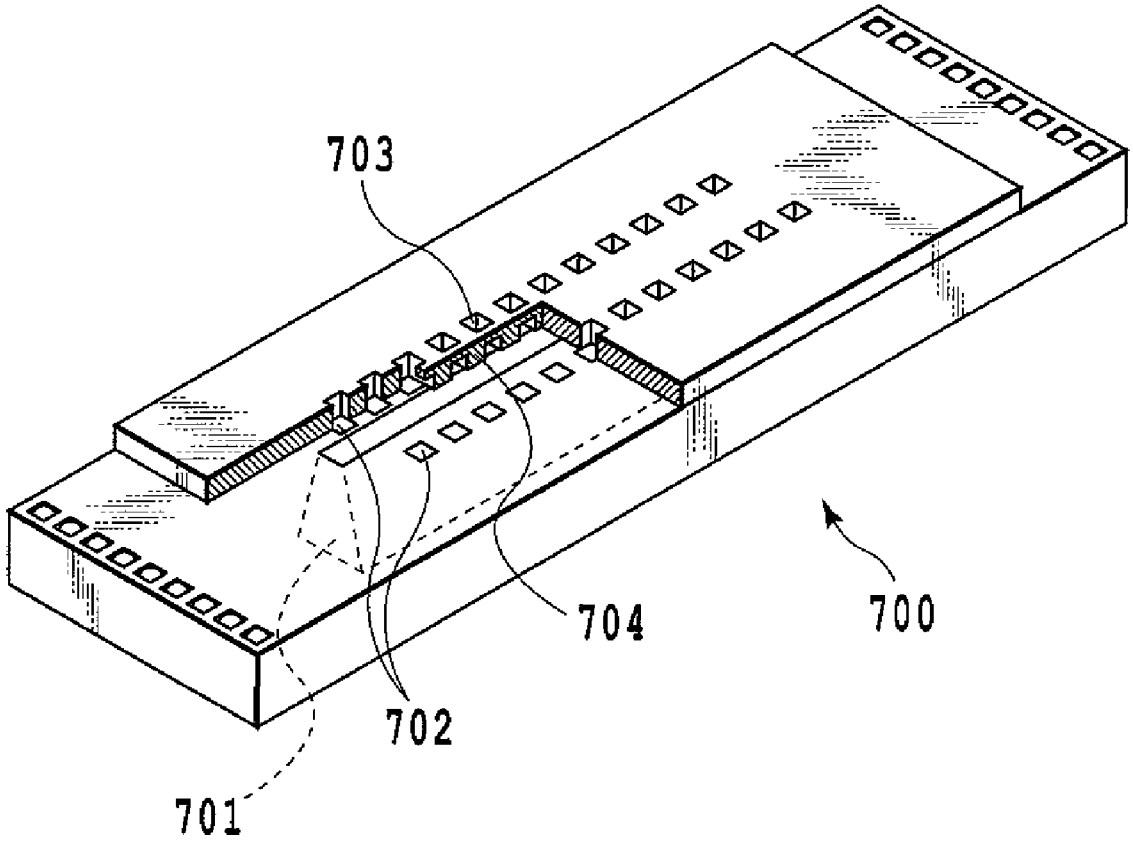
FIG. 9 is a perspective view, shown by partially broken away, of the printing device board of the printhead according to the first embodiment.
Figure 10A:
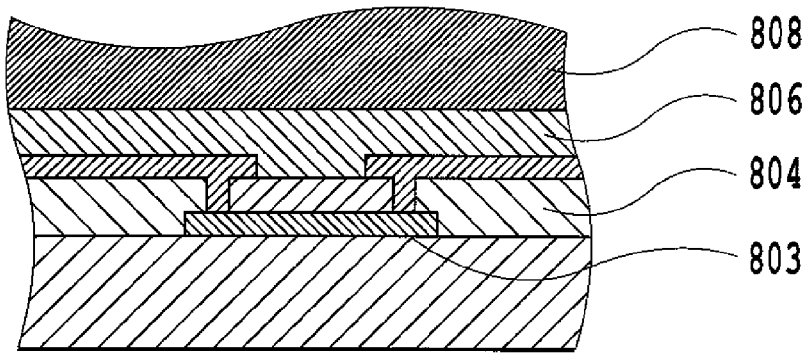
FIG. 10A shows a usual state of the printhead substrate while FIG. 10B a state that cracks are caused in an interlayer insulation film and protection film.
Figure 10B:
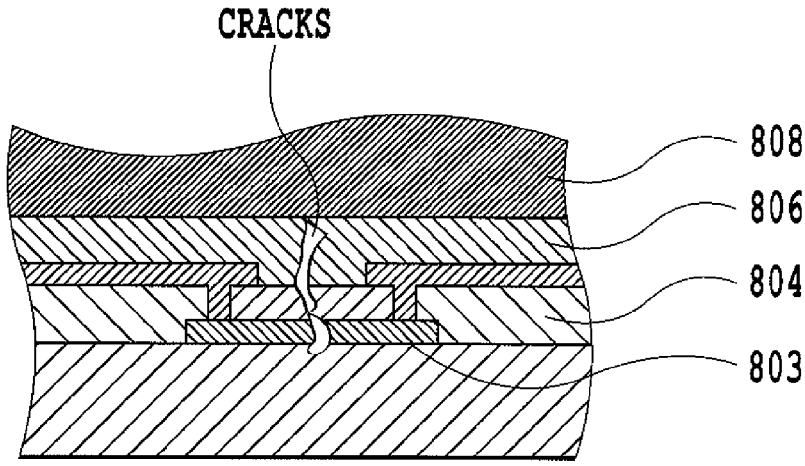

FIG. 9 is a perspective view, shown partially broken away, of the printhead 601 according to the present embodiment. A printing device board 700, i.e. printhead board, is made by an Si substrate having a thickness of from 0.5 to 1 mm and formed with an ink supply opening 701, an ink passage 704 and the like. The ink supply opening 701, i.e. a through-hole in the form of an elongate groove, is formed by anisotropic etching or sandblast utilizing the crystal orientation of Si. On both sides of the ink supply opening 701 ink is to be supplied, there are arranged electro-thermal converter elements 702 that are a plurality of energy generating elements. Ejection openings 703 are provided above the electro-thermal converter elements 702, in positions corresponding to the electro-thermal converter elements 702. The ink, supplied from the ink supply opening 701, is delivered to the ejection openings 703 through the ink passage 704. By actuating the electro-thermal converter elements 702, ink is to be ejected as droplets through the ejection openings 703.

In this embodiment, unique information is to be printed by use of an information storage device as a storage device to print the unique information about the printhead, in place of a fuse element conventionally used. Here, explanation is made in detail on the information storage device to be used in the present embodiment.

Figure 1:
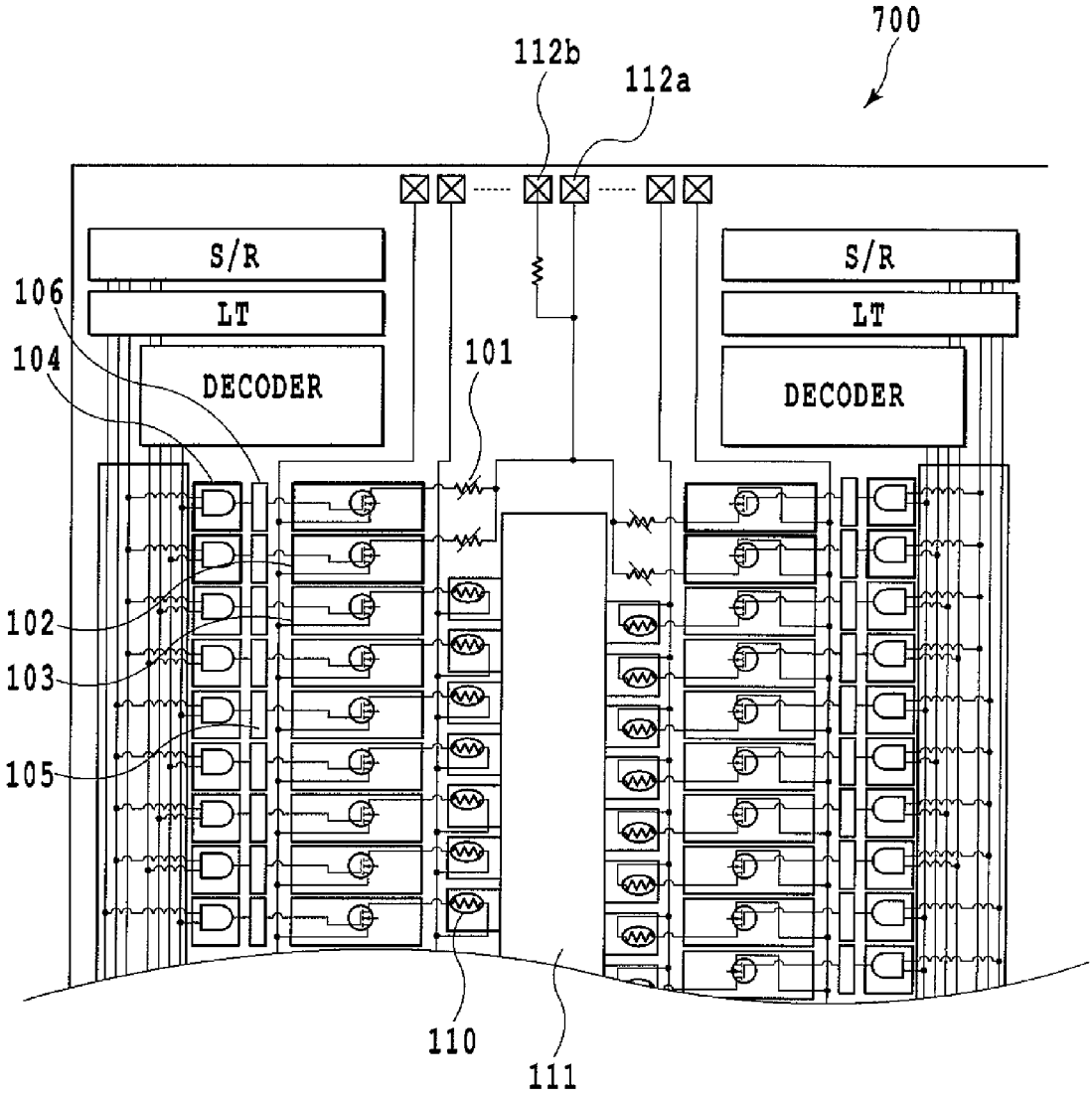
FIG. 1 is a figure showing a printing device board according to a first embodiment.

FIG. 1 is a figure showing an inkjet printhead board (printing device board) 700 according to a first embodiment, which is typically shown as is known from the circuit arrangement internally provided. An information storage element 101 is a resistor formed common in material and process to the electro-thermal converter elements 110 for use in ejecting an ink droplet, which can be formed without the necessity of an especial material or process. The information storage elements 101 and electro-thermal converter elements 110, in the embodiment, are formed by using a reactive sputtering process to be carried out in a nitrogen atmosphere using an alloy target based on Cr and Si. The CrSiN thin film formed by the process is generally an amorphous thin film. It is generally known that an amorphous alloy has an electric resistance comparatively greater in value as compared to that of the alloy in a crystalline state. The CrSiN thin film formed in the embodiment is unexceptionally high in electric resistance value. It is known that, by thermally processing the high-resistant CrSiN thin film at from 400 to 700° C., CrSi microcrystals are formed to constitute a structure low in resistance and stable in crystallinity. It is also known that, by heating the high-resistant CrSiN thin film at a temperature (equal to or higher than 200° C. and lower than 400° C.) lower than the above thermal process, a resistance value is provided in accordance with the temperature of heating.

Therefore, in the present embodiment, electro-thermal converter elements 110 and information storage elements 101 are formed by utilization of the relevant phenomenon. Namely, the embodiment uses, for electro-thermal converter elements 110, a CrSiN thin film that is stabilized in crystallinity and reduced in resistance by conducting a process with heating at a temperature of from 400 to 700° C. Meanwhile, for information storage elements 101, processing is conducted at a temperature of equal to or higher than 200° C. and lower than 400° C. to thereby provide unique resistance values respectively to the information storage elements 101.

In the embodiment, when forming elements (electro-thermal converter elements 110 and information storage elements 101) by heating the CrSiN thin film, the self-heating of the CrSiN thin film is used that is caused by applying a pulse voltage to the CrSiN thin film. Namely, by changing the number of application pulses, heat-generation temperature is changed to obtain a desired state.

Figure 2:
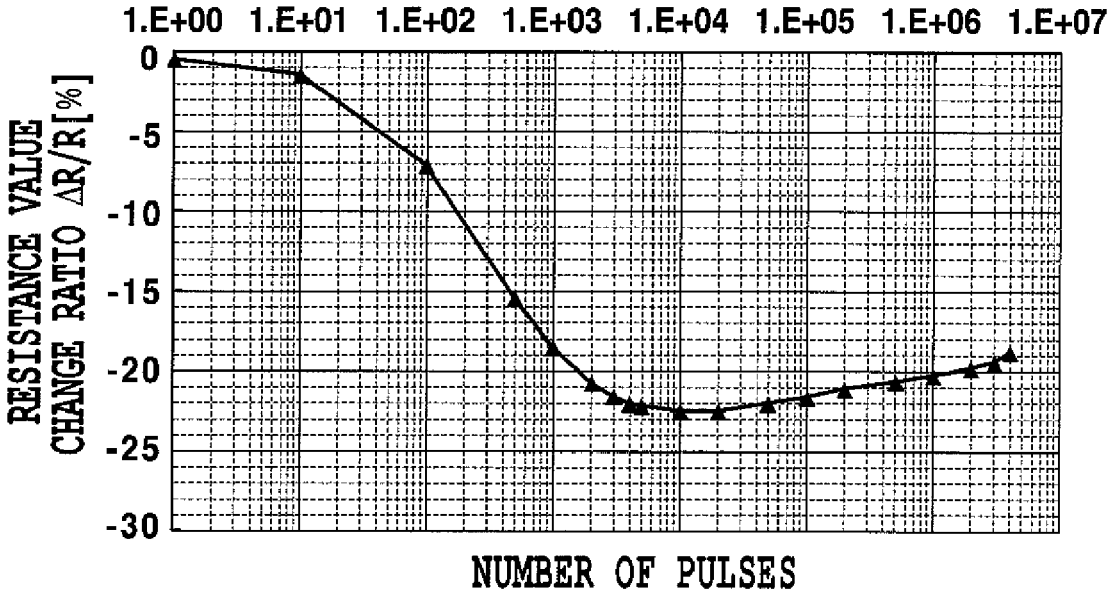
FIG. 2 is a graph showing a change of a resistance value of an information storage element with a change of the number of pulses.

FIG. 2 is a graph representing a change of resistance value of the information storage element 101 against the number of pulses. In the state no pulse voltage is applied, resistance value is high. As the number of pulses increases, resistance value gradually decreases. It can be seen that the change of resistance value is smaller in the neighborhood a predetermined number of pulses is exceeded.

By utilizing the change of resistance value, two or more resistance values can be exhibited correspondingly to the information to store. For example, at least three values of information can be stored by using a state of high resistance value, a state of low resistance value and a state of desired resistance value intermediate between those. The information to store is, for example, a difference of drive characteristic unique to the printhead resulting from the variation caused in the manufacture of the printhead. By classifying it into several ranks (e.g. three), processing can be made such that the information storage element 101 exhibits a resistance value correspondingly to the rank. The processing can be carried out together with a test process after the manufacture of a board or a printhead. Due to this, when the printhead is used by being mounted on a printer, the printer is allowed to read the resistance value (rank information) thereby effecting drive under conditions suited for the printhead.

Referring again to FIG. 1, the printing device board 700 is formed with drive elements for controlling the current supply to electro-thermal converter elements 110 and information storage elements 101, together with required wiring, on an Si substrate by use of a semiconductor manufacturing process.

The information storage elements 101 are arranged side by side on an extension of the array of the electro-thermal converter elements 110, thus being designed to use equal voltage to the voltage for driving the electro-thermal converter elements 110. Consequently, a voltage pulse can be applied to the information storage elements 101 without newly increasing a power source separately from the power source for supplying voltage to the electro-thermal converter elements 110. Driving the information storage elements 101 on the equal voltage to the electro-thermal converter elements 110 requires a second drive element 102, used for driving the information storage element 101, to withstand the equal voltage to a first drive element 103 for driving the electro-thermal converter elements 110. Therefore, by forming second drive elements 102 in the common structure and process to the first drive elements 103 for driving the electro-thermal converter elements 110, the second drive elements 102 having required breakdown characteristics can be formed without adding any other process in the manufacture.

Incidentally, because the operation voltage (logic voltage) of a logic circuit 104 for selectively supplying a drive signal to the second drive element 102 is generally lower than the voltage for driving the second drive element 102, the second drive element 102 cannot be driven unless making any change. For this reason, a booster circuit 106 is provided in front of the second drive element 102 so that the second drive element 102 can be driven on the signal selected at the logic circuit 104. Here, this is true for the first drive element 103 for driving the electro-thermal converter element 110, wherein a booster circuit (not shown) having the same configuration is used. The booster circuit uses a power voltage based on a power source (not shown) provided in the same printing device board 700.

The select signal for selecting the second drive element 102 and the select signal for selecting the first drive element 103 are both on the same signal system. A logic circuit 104 for selecting the second drive element 102 is connected parallel with the logic circuit for selecting the first drive element 103. Namely, the first and second drive elements share a signal line for sending a select signal to the first drive element 103, a time sharing drive signal decoder, a latch circuit (LT), a shift register (S/R) and external signal input pads (not shown). Therefore, the second drive element 102 can be selected to drive the information storage element 101 without adding new signal lines, wiring areas, circuits and the like.

As shown from FIG. 1, in this embodiment, the second drive elements 102 for selectively activating the information storage element 101 lies on an extension of the array of the first drive elements 103, one of which is arranged adjacent to the outermost first drive element 103.

The above structure provides an arrangement covering from the logic circuit 104 to the information storage element 101 equally to an arrangement covering from the logic circuit 104 to the electro-thermal converter element 110. Accordingly, the printing device board 700 can be manufactured easily without having an effect upon the arrangement of an in-board aperture of the ink supply opening 111 and signal lines, to suppress the size increase of the printing device board 700. Furthermore, by arranging similar circuits on both sides of the ink supply opening 111, space can be effectively utilized over the printing device board 700, which makes it possible to arrange the information storage elements with high density.

In the printing device board 700 of this structure, when storing information in the information storage element 101, the second drive element 102 is selectively driven corresponding to the information storage element 101 thereby applying a 24V pulse voltage separately to the information storage element 101. Specifically, the information storage elements 101 are changed to desired resistance values by applying a pulse voltage of from 0.1 μsec to 100 μsec (self-heating of the information storage element 101 corresponding to a temperature equal to or higher than 200° C. and lower than 400° C.) to a terminal 112*a*. Information can be stored by linking the changed resistance value of the information storage element 101 to the information unique to the printhead. Meanwhile, a 24V pulse voltage, capable of causing a self-heating at 400 to 700° C., is applied to those for use as electro-thermal conversion elements 110, to form electro-thermal conversion elements 110 stable in crystallinity and low in resistance.

The present inventors have confirmed that no damages nor cracks occur in the interlayer insulation film and protection film existing above the electro-thermal converter elements 110 even at a self-heating temperature of 700° C. for use in forming the electro-thermal converter elements 110. It is therefore natural that the interlayer insulation film and the protection film are not damaged upon forming electro-thermal converter elements 110 at a temperature lower than 700° C. Meanwhile, when storing information to the information storage element 101, no damages are naturally caused in the interlayer insulation film and protection film because information storage is at a temperature lower than that.

Figure 3:
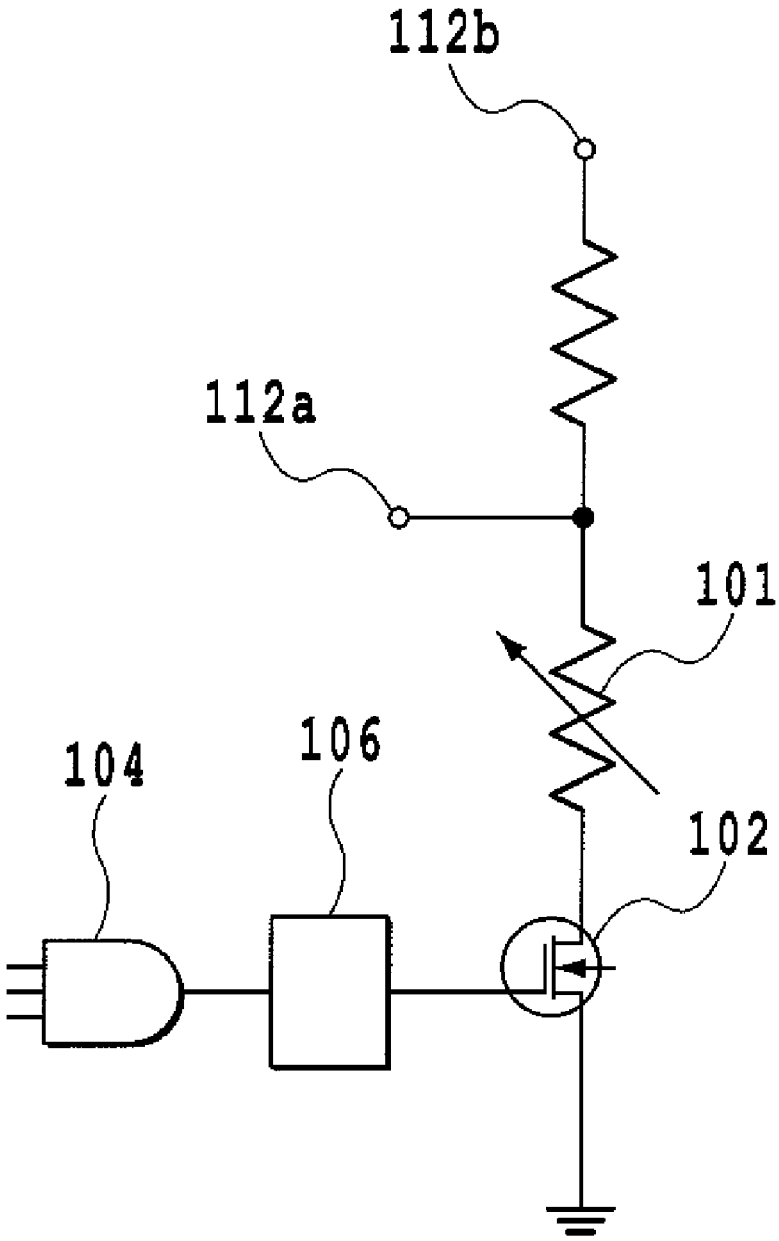
FIG. 3 is a figure showing an equivalent circuit to a circuit for holding information with using the information storage element.
Figure 4:
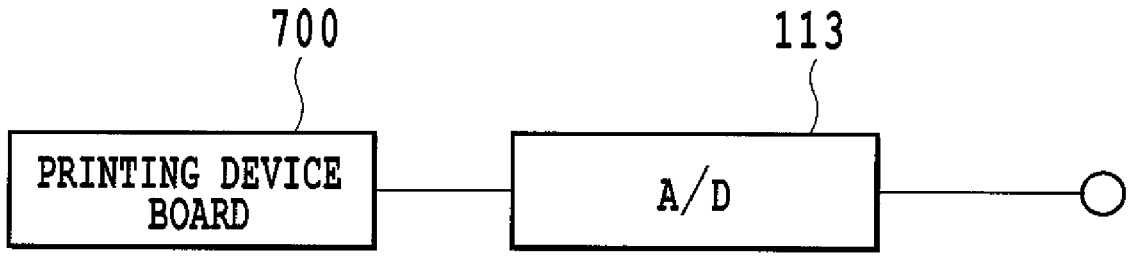
FIG. 4 is a block diagram showing a relationship between an A/D converter and a printing device board.

FIG. 3 is a figure showing an equivalent circuit to an information hold circuit using an information storage element 101. FIG. 4 is a block diagram showing a relationship between an A/D converter that converts an analog output into a digital value and a printing device board 700.

When reading stored information, a read voltage, for example, of 3.3 V is applied to the terminal 112*a*, followed by driving the second drive element 102 corresponding to the information storage element 101 to read. As a result, by obtaining voltage-drop information corresponding to the resistance value possessed by the information storage element 101 through the count terminal 112*b*, it is possible to obtain resistance information about the information storage element 101, i.e. information unique to the printhead. This may be given correspondingly to the 2 values, i.e. high resistance state (may be in a state not thermally processed) and low resistance state, or to three values or more of information with using one or more desired states intermediate of those. The resistance information obtained here is converted into a digital signal by the A/D converter 113. For example, three values can be set to the A/D converter such that resistance information obtained is Hi when greater than a certain resistance value R1, Mid when equal to or greater than a resistance value R2 and smaller than the resistance value R1 (>R2) or Low when smaller than the resistance value R2. The A/D-converter-included circuit, used in reading information in this manner, may be provided on the printing device board 700 or on the side of the inkjet printer 500. Meanwhile, by arranging the information storage elements side by side as shown in FIG. 1, it is possible to store information greater in the number or greater in types.

In this manner, the present embodiment uses information storage elements 101 formed, on printing device board 700, common in material and process to electro-thermal converter elements 110 so that information can be stored by changing the resistance value thereof through thermal process and be read out of the information storage element 101. This enables printing without causing a damage to the interlayer insulation film and protection film when storing information, thus realizing an inkjet print board and inkjet printhead having reliable storage elements free from positional restrictions in arrangement.

Second Embodiment

Now a second embodiment is explained.

Figure 5:
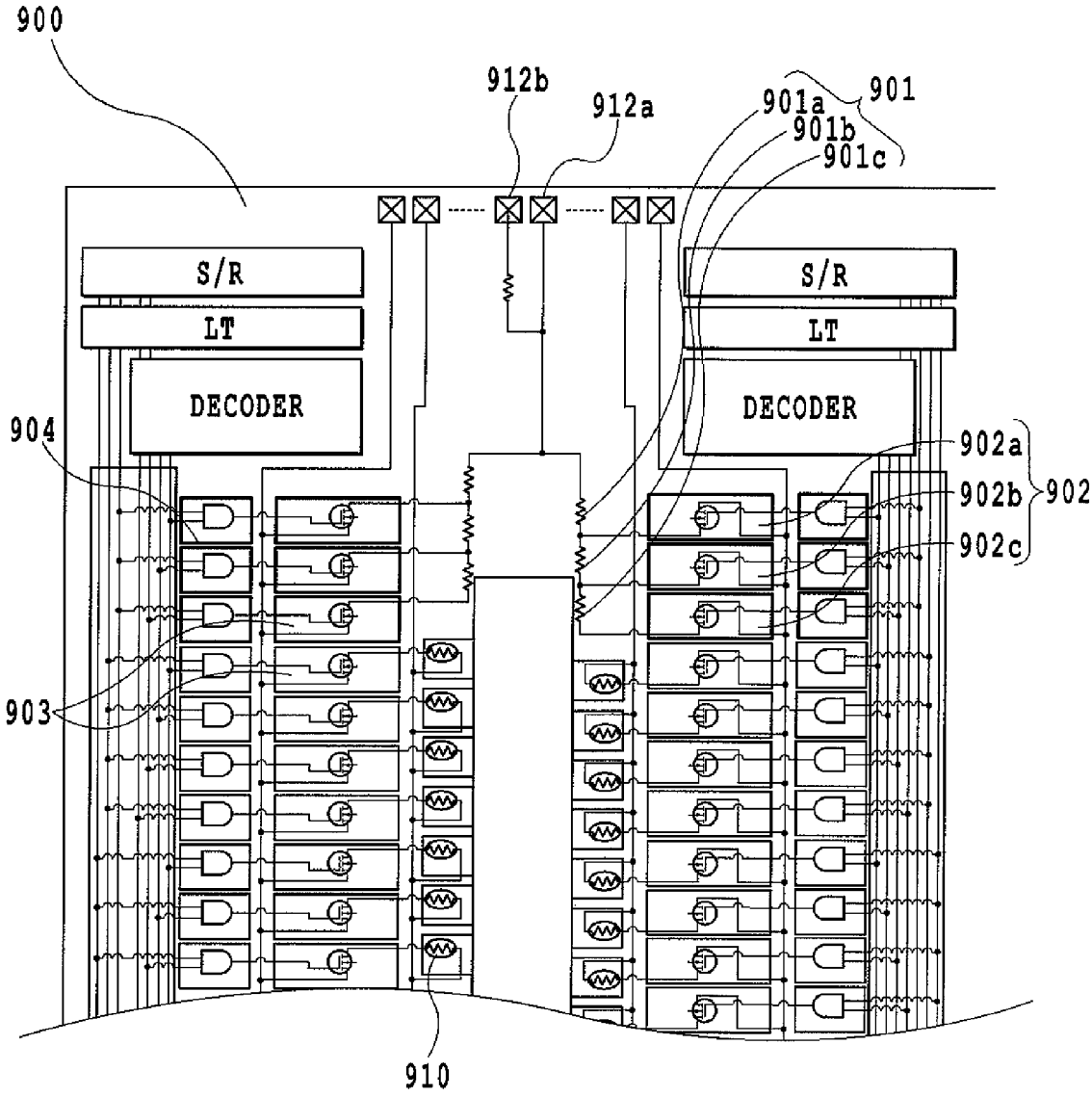
FIG. 5 is a figure showing a printing device board according to a second embodiment.
Figure 6:
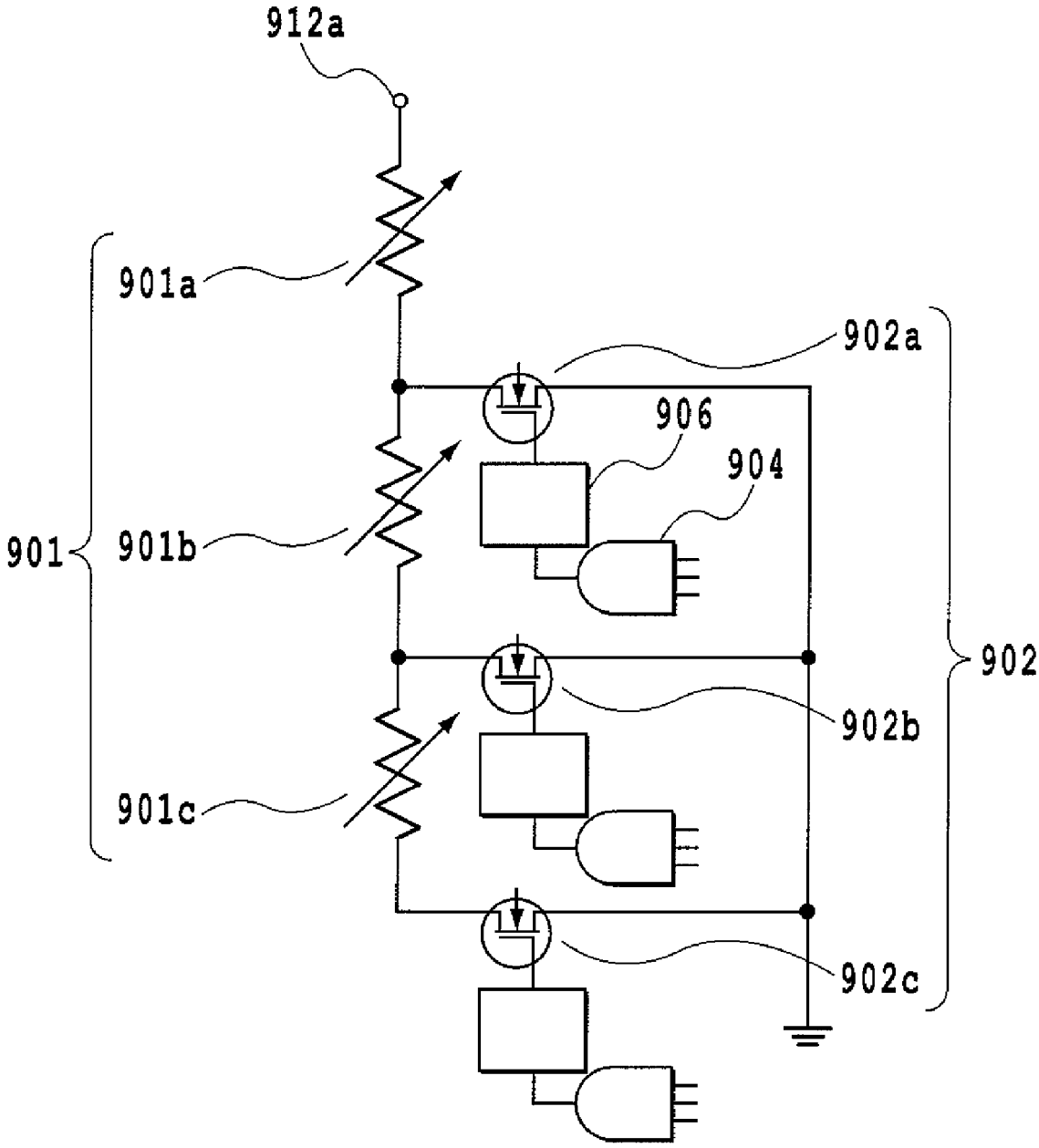
FIG. 6 is a figure showing an equivalent circuit to a circuit for holding information with using the information storage element.

FIG. 5 is a figure showing a printing device board 900 according to a second embodiment, which is shown to know a circuit configuration internally provided. Meanwhile, FIG. 6 is a diagram showing an equivalent circuit to the circuit that holds information with use of information storage elements 901. This embodiment is similar to the first embodiment but different in the configurational connection form of the resistors constituting the information storage element. Namely, the first embodiment juxtaposed with information storage elements 101 each configured by a single resistor, as shown in FIG. 1. On the contrary, the present embodiment has information storage element sets 901 each of which is in a form that a plurality of information storage elements are arranged in series.

In this embodiment, the information storage element set 901, provided in series on an extension of the array of electro-thermal converter elements 910, is designed to use a voltage equal to the voltage for driving the electro-thermal converter element 910. The other structure than the information storage element set 901, i.e. the structure of the electro-thermal converter element 910, first drive element 903, second drive element 902, logic circuit 904 and booster circuit 906 (see FIG. 6), is similar to the first embodiment.

Where resistors are arranged in series as in the present embodiment, the procedure of writing and reading data to and from the information storage element 901 is different from that of the first embodiment, which is hence explained. In this case, explanation is on the case to store 2 values information to the information storage element.

Here, six points a1, a2, b1, b2, c1 and c2 are taken at which resistance value increases (i.e. temperature/the number of application pulses decreases) in order on a change curve of a resistance against a temperature (the number of application pulses) (FIG. 2). The point a1 or a2 is assumed set to the information storage element 901*a*, the point b1 or b2 is to the information storage element 901*b*, and the point c1 or c2 is to the information storage element 901*c*, respectively.

In storing data on the information storage element 901*a* of the present embodiment, the second drive element 902*a* is first driven to change the resistance of the information storage element 901*a* at a predetermined pulse voltage to a desired value (a1 or a2). For the information up to 2 values, the second drive element 902*a* is driven to supply energy to the information storage element 901*a* and change the resistance value thereof.

After storing the information up to 2 values, the second drive element 902*b* is driven to supply energy to the information storage elements 901*a*, 901*b* thereby changing the resistance of the information storage element 901*b* to a desired value (a1 or a2). However, in this case, the number of application pulses is reduced than that upon energy supply to the information storage element 901*a* through driving the second drive element 902*a*. By doing so, the resistance value of the information storage element 901*b* can be changed without changing the resistance value of the information storage element 901*a*. For the information greater than two values and up to four values, the second drive element 902*b* is driven to supply energy to the information storage element 901*b* and change the resistance value thereof.

After storing the information up to four values, the second drive element 902*c* is then driven to supply energy to the information storage elements 901*a*, 901*b*, 901*c* thereby changing the resistance of the information storage element 901*c* to a desired value (c1 or c2). However, in this case, the number of application pulses is reduced than that upon energy supply to the information storage elements 901*a*, 901*b* through driving the second drive element 902*b*. By doing so, the resistance value of the information storage element 901*c* can be changed without changing the resistance values of the information storage elements 901*a*, 901*b*. Because the respective resistance values of the information storage elements 901*a*, 901*b* are known, resistance value can be read on the information storage element 901*c*.

In reading the recorded data, data is first read out of the information storage element 901*a*. In this case, after applying a read voltage, for example, of 3.3 V to the terminal 912*a*, the second drive element 902*a* is driven corresponding to the information storage element 901*a* to read. As a result, voltage drop information is obtained corresponding to the resistance value of the information storage element 901*a* through a count terminal 912*b*, thereby obtaining resistance information about the information storage element 901*a*.

In reading the resistance value from the information storage element 901*b*, a read voltage of 3.3 V is similarly applied to the terminal 912*a*, to drive the second drive element 902*b* corresponding to the information storage element 901*b*. The information, obtained from the count terminal 912*b* on this occasion, is given as voltage drop information commensurate with the resultant resistance of the resistance value the information storage element 901*a* possesses and the resistance value the information storage element 901*b* possesses. Accordingly, in obtaining a resistance from the information storage element 901*b*, calculation is by subtracting the resistance value of the information storage element 901*a* from the resultant resistance obtained. In obtaining the recorded data from the information storage element 901*c*, calculation is similarly from the resultant resistance of the information storage elements 901*a*, 901*b*, 901*c*.

Incidentally, information storage operation is not limited to the foregoing. For example, the procedure may be as in the following. At first, the second drive element 902*c* only is selected to set the information storage elements 901*a*-901*c* all at c1 or c2. Then, the second drive element 902*b* only is selected to set the information storage elements 901*a*, 901*b* at b1 or b2.

Finally, the second drive element 902*a* only is selected to set the information storage element 901*a* at a1 or a2.

By thus storing information to the information storage element and separately reading information therefrom, information can be handled in a degree up to 2 values×3=6 values. In addition, the information stored can be combined properly, thus being handled in a degree up to maximally (2 values)$^3$=8 values.

The information to be stored in the information storage elements is not limited to two values but may be three values or more. For example, four-valued information can be stored on each element similarly to the above. In such a case, information can be handled in a degree of from 4 values×3=12 value to (4 values)$^3$=64 values. Furthermore, the number of information storage elements is naturally not limited to the foregoing example.

As described above, the present embodiment is arranged with information storage elements 901 formed, on printing device board 900, common in material and process to electrothermal converter elements 910 so that information can be stored by changing the resistance value thereof and be read out of the information storage element 901. This enables printing and reading information without causing a damage to the interlayer insulation film and protection film when data, thus realizing an inkjet print board and inkjet printhead having reliable storage elements free from positional restrictions in arrangement.

Other Embodiments

The information storage elements illustrated in the embodiments are not limited in the number but can be provided in plurality as long as space is available over the printing device board.

The embodiment utilized self-heating of the information storage element itself caused upon applying a pulse voltage, as a method to heat up the information storage element. However, this is not limitative. Namely, heating may be in a temperature-controlled bath or the like provided that temperature control is available with accuracy.

The inkjet printhead board in the invention satisfactorily has elements that generate energy for ejecting ink, having a resistance value corresponding to the temperature of thermal process and a resistor, as an information storage element, for reading the resistance value thereof.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-343000, filed Dec. 20, 2006, which is hereby incorporated by reference herein in its entirety.

What is claimed is:

1. An inkjet print head board comprising:

a plurality of information storage elements made from a material the resistance value of which changes by thermal treating, and which are able to store information according to resistance value;

a first terminal to apply a first voltage to thermally treat the plurality of information storage elements and a second voltage to read information that the plurality of information storage elements store;

a second terminal to connect the plurality of information storage elements to ground;

a plurality of drive elements to control on and off of power supply to the information storage elements; and a third terminal to output as a voltage information on voltage drop according to resistance of the information storage element that is energized.

2. The inkjet print head board according to claim 1, wherein the material of the plurality of information storage elements is amorphous, formed of Cr, Si and N, and CrSi micro-crystal is contained in at least one of the information storage elements.

3. The inkjet print head board according to claim 2, wherein the resistance of the information storage elements with a larger content of the CrSi microcrystal is lower than the information storage elements with a smaller content of the CrSi microcrystal.

4. The inkjet print head board according to claim 2, wherein the CrSi microcrystal is provided by thermal processing of the amorphous Cr, Si and N.

5. The inkjet print head board according to claim 1, wherein the plurality of information storage elements are connected in parallel between the first terminal and the second terminal.

6. The inkjet print head board according to claim 1, wherein the plurality of information storage elements are serially connected between the first terminal and the second terminal.

7. The inkjet print head board according to claim 1 further comprising:

a plurality of an energy generating elements that generate thermal energy to eject liquid, wherein the energy generating elements are made of the same material as the information storage elements.

8. The inkjet print head board according to claim 1, wherein at least two-value information is stored in resistors constituting the information storage elements.

9. An inkjet print head comprising:

an inkjet print head board according to claim 1; and an ejection opening through which ink is to be ejected in response to a thermal generation by the resistors constituting the energy generating elements.

* * * * *